US009044054B2

(12) United States Patent
Raymer, Jr.

(10) Patent No.: US 9,044,054 B2
(45) Date of Patent: Jun. 2, 2015

(54) SHOE-MOUNTED PANTS CUFF PROTECTIVE DEVICE

(71) Applicant: Kenneth R. Raymer, Jr., Bensenville, IL (US)

(72) Inventor: Kenneth R. Raymer, Jr., Bensenville, IL (US)

( * ) Notice: Subject to any disclaimer, the term of this patent is extended or adjusted under 35 U.S.C. 154(b) by 60 days.

(21) Appl. No.: 14/033,442

(22) Filed: Sep. 21, 2013

(65) Prior Publication Data

US 2014/0082973 A1 Mar. 27, 2014

Related U.S. Application Data

(60) Provisional application No. 61/704,485, filed on Sep. 22, 2012.

(51) Int. Cl.

| | |
|---|---|
| ***A43B 3/16*** | (2006.01) |
| ***A41F 17/04*** | (2006.01) |
| ***A41D 27/12*** | (2006.01) |
| ***A41F 17/02*** | (2006.01) |
| ***A43C 19/00*** | (2006.01) |

(52) U.S. Cl.

CPC ..... *A41D 27/12* (2013.01); *A43B 3/166* (2013.01); *A41F 17/02* (2013.01); *A43C 19/00* (2013.01)

(58) Field of Classification Search

CPC ..... A41F 17/02; A41F 17/04; A41F 17/00; A44C 1/00; A43C 11/24; A43C 19/00; A43C 17/00; A42B 7/00; A43B 1/0054; A43B 3/18; A43B 3/166; A41D 27/12

USPC ..... 36/70 R, 1, 71.5, 72 R, 72 B, 136, 132; 24/72.1, 523, 527, 530, 298, 301; 2/232, 233, 312, 323, 245, 257, 324, 2/325, 326

See application file for complete search history.

(56) References Cited

U.S. PATENT DOCUMENTS

| | | | | | |
|---|---|---|---|---|---|
| 397,704 | A | * | 2/1889 | Diamond et al. | 36/70 R |
| 562,150 | A | * | 6/1896 | Newton | 24/72.1 |
| 586,666 | A | * | 7/1897 | Neuendorff | 36/70 R |
| 640,277 | A | * | 1/1900 | Daniels | 36/70 R |
| 647,124 | A | * | 4/1900 | Williams | 24/485 |
| 668,051 | A | | 2/1901 | Puffer | |
| 868,567 | A | | 10/1907 | Jensen | |
| 877,332 | A | * | 1/1908 | Hayden | 2/325 |

(Continued)

FOREIGN PATENT DOCUMENTS

| | | |
|---|---|---|
| GB | 1901-10475 | 5/1902 |
| GB | 1903-02798 | 2/1903 |

(Continued)

*Primary Examiner* — Jila M Mohandesi
*Assistant Examiner* — Katherine Gracz
(74) *Attorney, Agent, or Firm* — Corridor Law Group, P.C.

(57) ABSTRACT

A shoe-mounted pants cuff protective device includes a central hub, a plurality of legs, and a plurality of slideable sleeves. Each leg has a hole at its proximal end for pivotably mounting a leg on a pin formed in the central hub. Each sleeve has an interior lumen with an opening that receives a leg such that the leg is slideable within the lumen. Each of the sleeves has positioning holes allow the sleeve to be fastened in one of several locations along the leg to adjust the distance from the central hub to the distal end of the sleeve. Each of the sleeves includes a spring clip extending outwardly from the distal end of the leg. The clip is capable of releasably securing a length of pants cuff fabric between the clip and its corresponding sleeve.

9 Claims, 4 Drawing Sheets

(56) References Cited

U.S. PATENT DOCUMENTS

| | | | | | |
|---|---|---|---|---|---|
| 898,503 | A | * | 9/1908 | Plummer | 24/299 |
| 933,311 | A | * | 9/1909 | Klein | 24/17 R |
| 1,363,592 | A | * | 12/1920 | Hermanson | 24/523 |
| 1,412,033 | A | * | 4/1922 | Able | 2/323 |
| 1,432,780 | A | | 10/1922 | Ordakowski | |
| 1,458,353 | A | * | 6/1923 | Morse | 2/309 |
| 1,520,739 | A | | 12/1924 | Zetlitz | |
| 1,668,480 | A | * | 5/1928 | Stafford et al. | 36/58.5 |
| 1,668,481 | A | * | 5/1928 | Stafford et al. | 36/58.5 |
| 1,782,057 | A | | 11/1930 | Bollinger | |
| 1,828,421 | A | * | 10/1931 | Levinsky | 24/530 |
| 2,061,385 | A | * | 11/1936 | Nadler | 24/342.1 |
| 2,107,516 | A | | 2/1938 | Bishop | |
| 2,411,161 | A | * | 11/1946 | Jackson | 2/325 |
| 2,616,189 | A | * | 11/1952 | Smith | 36/1 |
| 2,871,538 | A | * | 2/1959 | Richardson | 24/530 |
| 3,052,891 | A | * | 9/1962 | Panepinto | 2/301 |
| 3,068,593 | A | * | 12/1962 | O'Donnell | 36/72 R |
| 3,559,515 | A | * | 2/1971 | Kyser | 1/427 |
| 3,995,382 | A | * | 12/1976 | Smith | 36/72 R |
| 4,005,534 | A | * | 2/1977 | Crist et al. | 36/72 R |
| 4,026,047 | A | * | 5/1977 | Ahmer | 36/136 |
| 4,853,979 | A | * | 8/1989 | Ryder | 2/326 |
| 4,937,886 | A | * | 7/1990 | Ellis | 2/323 |
| 5,117,538 | A | * | 6/1992 | Henry | 24/298 |
| 5,129,105 | A | * | 7/1992 | Kleinman | 2/328 |
| 5,313,669 | A | * | 5/1994 | Rasdell et al. | 2/323 |
| 5,542,156 | A | | 8/1996 | Oglesby | |
| 5,655,270 | A | * | 8/1997 | Boisvert | 24/336 |
| 6,054,091 | A | | 4/2000 | Miller et al. | |
| 6,530,131 | B1 | * | 3/2003 | Hopkins | 24/300 |
| 6,618,862 | B1 | | 9/2003 | Bunjes | |
| 6,701,582 | B1 | | 3/2004 | Milburn | |
| 6,829,847 | B2 | | 12/2004 | O'Shea et al. | |
| 6,868,555 | B2 | * | 3/2005 | Zic et al. | 2/67 |
| 7,086,123 | B2 | | 8/2006 | Carter | |
| 7,237,306 | B1 | | 7/2007 | Flowers et al. | |
| 7,272,862 | B1 | | 9/2007 | Ellington | |
| 7,458,950 | B1 | | 12/2008 | Ivany | |
| 7,471,593 | B2 | * | 12/2008 | Loring | 368/10 |
| 7,797,762 | B2 | | 9/2010 | Shapiro et al. | |
| 2006/0026990 | A1 | * | 2/2006 | Carter | 63/14.5 |
| 2007/0192998 | A1 | * | 8/2007 | Ryder | 24/1 |
| 2007/0277290 | A1 | | 12/2007 | Shapiro et al. | |
| 2007/0277292 | A1 | | 12/2007 | Lambert et al. | |
| 2008/0289225 | A1 | * | 11/2008 | Ali et al. | 36/70 R |
| 2009/0260262 | A1 | | 10/2009 | Munoz | |
| 2009/0313859 | A1 | | 12/2009 | Vernon et al. | |
| 2009/0320181 | A1 | | 12/2009 | MacGregor, Jr. | |
| 2010/0011626 | A1 | | 1/2010 | Ali et al. | |
| 2010/0205719 | A1 | | 8/2010 | Shires | |

FOREIGN PATENT DOCUMENTS

| | | | |
|---|---|---|---|
| JP | H08-260211 | A | 10/1996 |
| JP | H11-235391 | A | 8/1999 |
| JP | 2000-303217 | A | 10/2000 |
| WO | 2007145782 | A2 | 12/2007 |

* cited by examiner

SHOE-MOUNTED PANTS CUFF PROTECTIVE DEVICE

CROSS-REFERENCE TO RELATED APPLICATION

This application is related to and claims priority benefits U.S. Provisional Patent Application Ser. No. 61/704,485 filed on Sep. 22, 2012, entitled "Shoe-Mounted Pants Cuff Protective Device". The '485 provisional application is hereby incorporated by reference herein in its entirety.

FIELD OF THE INVENTION

The present invention relates to apparel. In particular, the present invention relates to a shoe-mounted clip for protecting pants cuffs from dragging on or touching the ground, or coming in close proximity to the ground.

BACKGROUND OF THE INVENTION

Pants cuff protection devices are prevalent in the apparel field, and many designs exist to prevent pants cuffs from dragging along the ground or even being stepped on by the wearer's shoes. Especially in the case of pants with flared bottoms, the cuffs can oftentimes extend below the soles of the wearer's shoes and, over time, the cuffs can become frayed or threadbare from the constant rubbing of the pants fabric against the ground and the associated frictional wear and tear. Even if the dragging against the ground is insufficient to lead to fraying, the pants can become soiled from touching or coming into close proximity to the ground, especially in rainy weather when dirt gets stirred up on sidewalks and streets. Pants cuff protectors are designed to prevent such wear and tear, as well as to keep the cuffs from touching or coming in close proximity to the ground.

Two exemplary prior art pants cuff protection devices are disclosed in Puffer U.S. Pat. No. 668,051 issued on Feb. 12, 1901 and Ordakowski U.S. Pat. No. 1,432,780 issued on Oct. 24, 1922. Puffer discloses a shoe-mounted pants cuff protective clip having the general "money clip" shape of your design, but Puffer's clip is not adjustable. Ordakowski's device for retaining overshoes on shoes is not designed for the protection of pants cuffs. Ordakowski's clip does, however, have an adjustability feature.

The present shoe-mounted pants cuff protective device overcomes many of the shortcomings of prior art cuff protectors like those disclosed in Puffer and Ordakowski. The present cuff protector is adjustable in length and width to accommodate different styles of pants and shoes. The present cuff protector has three basic parts that are simple in construction and therefore easily manufactured, and simple to assemble. Moreover, unlike most prior art designs, the present design does not substantially alter the appearance of the wearer's pants, as the cuffs are maintained in the same general location at the upper level of the sole of the wearer's shoe

SUMMARY OF THE INVENTION

A shoe-mounted pants cuff protective device comprises a central hub, a plurality of legs, and a plurality of extendable sleeves. The central hub comprising a plurality of mounting pins. Each of the legs has a hole at its proximal end for pivotably mounting the leg on one of the pins. Each of the legs has a button protruding from it distal end. Each extendable sleeve has an interior lumen with an opening at the proximal end of the sleeve. The interior lumen is capable of receiving one of the legs such that the leg is slideable within the sleeve lumen. Each of the sleeves has a plurality of positioning holes into which the button protruding from the leg can be releasably press-fitted. Each of the sleeves includes a spring clip extending outwardly from the distal end of the leg. The clip is capable of releasably securing a length of fabric between the clip and its corresponding sleeve.

In a preferred embodiment of the present cuff protective device, the hub comprises a pair of spaced-apart discs. The plurality of mounting pins extends from one of the discs toward holes formed in the other of the discs. The mounting pins are capable of being releasably press-fitted into the disc holes. The plurality of mounting pins preferably comprises four mounting pins, the plurality of legs comprises four legs, and the plurality of extension sleeves comprises four sleeves.

In another preferred embodiment, the button is formed integrally with the leg, and is more preferably molded integrally with the leg. Similarly, the spring clip is formed integrally with the extension sleeve, and is more preferably molded integrally with the extension sleeve.

In another preferred embodiment, the opening for the interior lumen in the extendable sleeve is flanged.

A method of protecting pants cuffs comprises:

(a) pivotably mounting a plurality of legs on a plurality of mounting pins extending from a central hub;

(b) slideably mounting each of the plurality of legs within the interior lumen of an extendable sleeve, each of the legs having a button protruding therefrom for releasably securing the leg to corresponding positioning holes formed in the sleeve, each of the sleeves comprising a spring clip extending outwardly from the distal end of the sleeve (c) releasably securing one of the spring clips to the back portion of a shoe;

(d) releasably securing the pants cuffs between the clip and its corresponding sleeve.

DETAILED DESCRIPTION OF PREFERRED EMBODIMENT(S)

Figure 1:
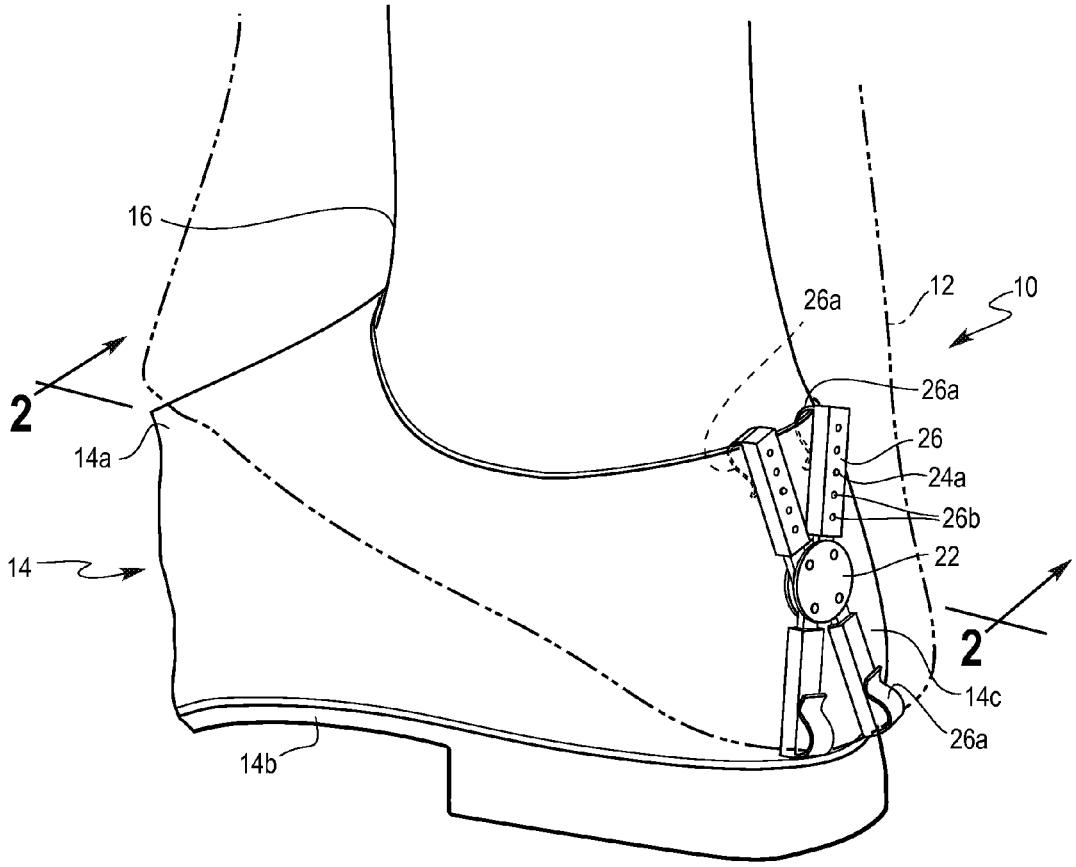
FIG. 1 is a perspective view of the present pants cuff protective device as mounted on the back portion of a wearer's shoe.
Figure 2:
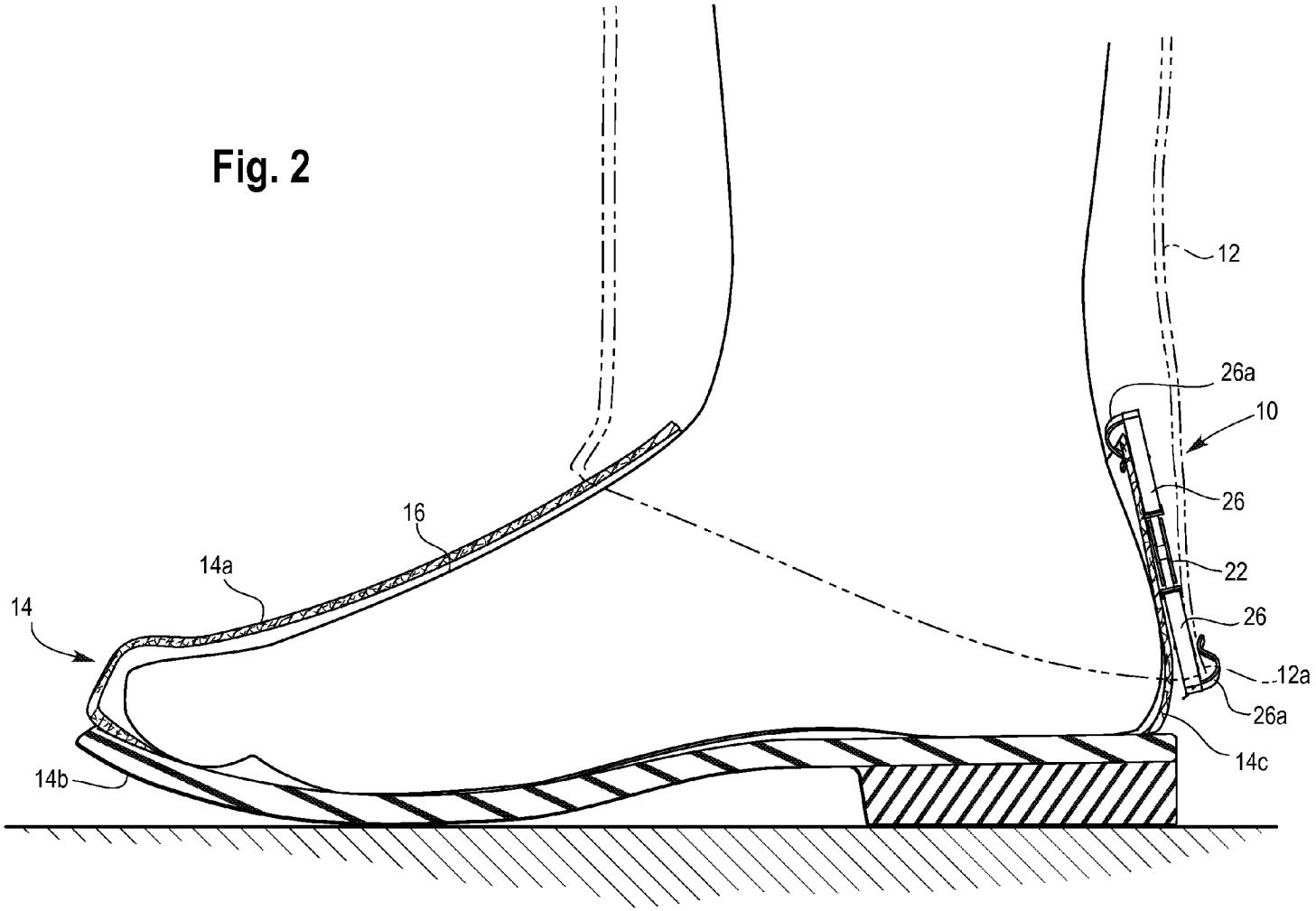
FIG. 2 is an cross-sectional elevation view, taken in the direction of arrows 2-2 in FIG. 1, of a shoe having the present pants cuff protective device mounted on the back portion of the shoe, also showing (in phantom lines) the pants cuff inserted into the spring clip of the present device.

Turning first to FIG. 1, a pants cuff protective device 10 is mounted to a shoe 14 at its back portion 14*c*. Shoe 14 also includes an upper portion 14*a* and a sole 14*b*. As further shown in FIG. 1, the wearer's pants 12 end in a cuff portion (shown in phantom lines), which is releasably mounted within pants cuff protective device 10. As shown in FIG. 2, pants cuff protective device 10 prevents pants cuff portion 12*a* from touching or coming in close proximity to the ground beneath shoe 14.

As further shown in FIG. 1, pants cuff protective device 10 comprises a hub 22, from which four legs extend, each leg having a sleeve 26 mounted thereon. Sleeve 26 has a spring clip 26*a* extending outwardly from its distal end. Clip 26*a* is capable of releasably securing the fabric at the cuff of pants 12 between clip 26*a* and its corresponding sleeve 26. Sleeve 26 has a plurality of positioning holes 26*b* formed therein into which a button 24*a* protruding from the corresponding leg (see FIGS. 4A and 4B) can be releasably press-fitted.

Turning next to FIG. 2, a wearer's foot 16 is shown inside of shoe 14, which in turn includes an upper portion 14*a* and a sole 14*b*. As further shown in FIG. 2, the wearer's pants 12 terminate in a cuff portion 12*a*, which is releasably mounted within pants cuff protective device 10. Pants cuff protective device 10 prevents pants cuff portion 12*a* from touching or coming into close proximity to the ground beneath shoe 14. FIG. 2 also shows pants cuff protective device 10 as comprising includes a disc-shaped hub 22, from which four legs extend, each leg having a sleeve 26 mounted thereon. As shown in cross-section in FIG. 7, a counterpart disc-shaped hub 23 is disposed in a spaced-apart configuration with respect to hub 22. Spring clip 26*a*, which extends outwardly from the distal end of sleeve 26, is capable of releasably securing the fabric at the cuff of pants 12 between clip 26*a* and its corresponding sleeve 26. At the shoe end of pants cuff protective device 10, another spring clip 26*a* is capable of releasably securing the back of the shoe between clip 26*a* and its corresponding sleeve 26.

Figure 3:
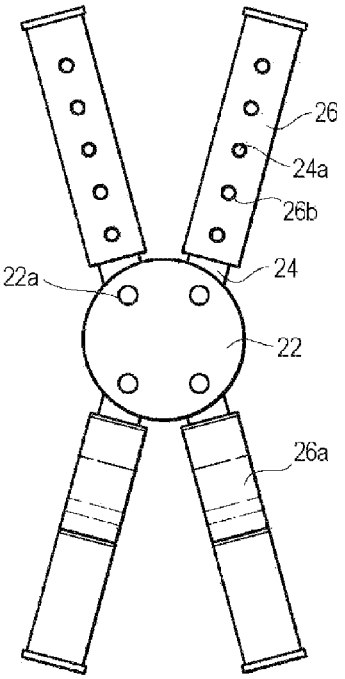
FIG. 3 is a front view of the present shoe-mounted pants cuff protective device in assembled form.

In FIG. 3, a shoe-mounted pants cuff protective device is shown in assembled form. The device includes a central hub 22, four legs, one of which is denoted in FIG. 3 as leg 24, and four extendable sleeves, one of which is shown as extendable sleeve 26 slideably mounted on leg 24.

Figure 3A:
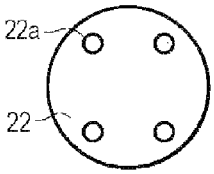
FIGS. 3A and 3B are front and side views, respectively, of the center hub of the present shoe-mounted pants cuff protective device.
Figure 3B:
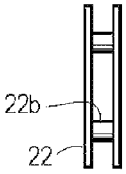

FIGS. 3A and 3B show front and side views of the center hub 22 component of the present shoe-mounted pants cuff protective device. Hub 22 includes a pair of spaced-apart discs with mounting pins 22*b* extending from one of the discs toward holes 22*a* formed in the other disc. Mounting pins 22*b* are capable of being releasably press-fitted into holes 22*a*.

Figure 4A:
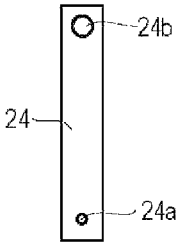
FIGS. 4A and 4B are front and side views, respectively, of one of the legs of the present shoe-mounted pants cuff protective device.
Figure 4B:
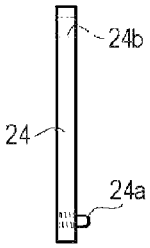

FIGS. 4A and 4B show front and side views of one of the leg components of the present shoe-mounted pants cuff protective device. As shown in FIG. 4A, leg 24 has a hole 24*b* formed at its proximal end for pivotably mounting leg 24 on one of pins 22*b* in central hub 22. Leg 24 also has a button 24*a* protruding from the distal end of leg 24.

Figure 5A:
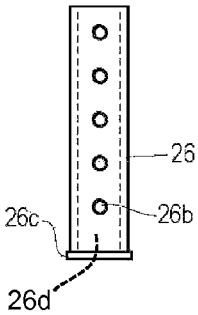
FIGS. 5A and 5B are front and side views, respectively, of one of the extension sleeves of the present shoe-mounted pants cuff protective device, also showing the spring clip extending from the distal end of the extension sleeve.
Figure 5B:
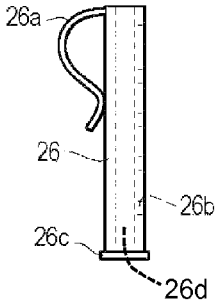

FIGS. 5A and 5B show front and side views of one of the extension sleeve components of the present shoe-mounted pants cuff protective device. Each of sleeves 26 has an interior lumen formed with a flanged opening 26*c* at the proximal end of sleeve 26. As also shown in FIG. 3, the interior lumen of sleeve 26 is capable of receiving leg 24 such that leg 24 is slideable within sleeve 26. Sleeve 26 has a plurality of positioning holes 26*b* formed therein, into which a button 24*a* protruding from leg 24 (see FIGS. 4A and 4B) can be releasably press-fitted. Positioning holes 26*b* allow sleeve 26 to be fastened in one of several locations along leg 24 to adjust the distance from central hub 22 to the distal end of sleeve 26. As further shown in FIGS. 5A and 5B, sleeve 26 is hollow, creating an interior lumen 26*d*.

As further shown in FIGS. 5A and 5B, sleeve 26 also has a spring clip 26*a* extending outwardly from the distal end of sleeve 26. Clip 26*a* is capable of releasably securing the fabric of a pants cuff (see FIG. 2) between clip 26*a* and its corresponding sleeve 26.

Figure 7:
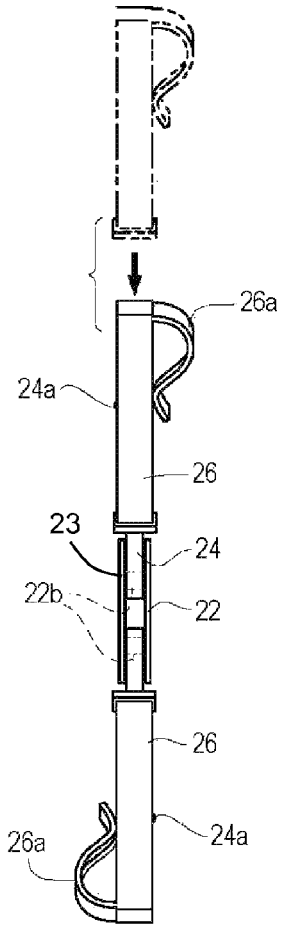
FIGS. 6 and 7 are a front and side views, respectively, of the present pants cuff protective device as one of the sleeves is being slipped onto one of the legs to complete assembly of the device.
Figure 6:
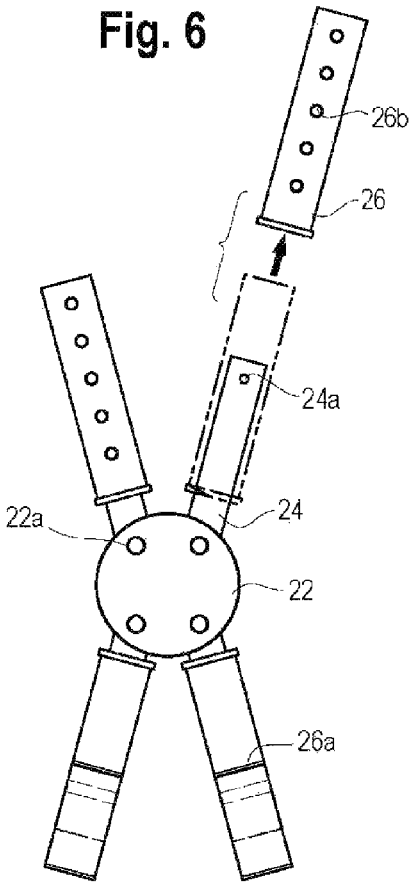

FIGS. 6 and 7 show pants cuff protective device being assembled as one of sleeves 26 is being slipped onto one of legs 24 to complete the device. As shown, hub 22 includes a pair of spaced-apart discs with mounting pins 22*b* extending from one of the discs forming hub 22 toward holes 22*a* formed in the other disc. Mounting pins 22*b* are capable of being releasably press-fitted into holes 22*a*.

As further shown in FIGS. 6 and 7, each of sleeves 26 has an interior lumen formed with a flanged opening 26*c* at the proximal end of sleeve 26. Sleeve 26 is slipped onto leg 24 such that leg 24 is slideable within sleeve 26. Sleeve 26 has a plurality of positioning holes 26*b* formed therein, into which button 24*a* protruding from leg 24 can be releasably press-fitted. Positioning holes 26*b* allow sleeve 26 to be fastened in one of several locations along leg 24 to adjust the distance from central hub 22 to the distal end of sleeve 26. Clips 26 are located at the distal end of sleeve 26.

While particular elements, embodiments and applications of the present invention have been shown and described, it will be understood, that the invention is not limited thereto since modifications can be made by those skilled in the art without departing from the scope of the present disclosure, particularly in light of the foregoing teachings.

What is claimed is:

1. A shoe-mounted pants cuff protective device comprising:

(a) a central hub comprising a plurality of mounting pins;

(b) a plurality of legs, each of said legs having a hole formed therein at the proximal end thereof for pivotably mounting said leg on one of said pins, each of said legs further having a button protruding from the distal end of said leg;

(c) a plurality of extendable sleeves, each of said sleeves having an interior lumen formed therein with an opening at the proximal end of said sleeve, said interior lumen capable of receiving one of said legs therein, said leg slideable within said sleeve lumen, each of said sleeves having a plurality of positioning holes formed therein into which said button protruding from said leg can be releasably press-fitted, each of said sleeves further comprising a spring clip extending outwardly from the distal end of said sleeve, said clip capable of releasably securing a length of fabric between said clip and its corresponding sleeve.

2. The cuff protective device of claim 1, wherein said hub comprises a pair of spaced-apart discs, said plurality of mounting pins extending from one of said discs toward holes formed in the other of said discs, said mounting pins capable of being releasably press-fitted into said disc holes.

3. The cuff protective device of claim 2, wherein said plurality of mounting pins comprises four mounting pins, said plurality of legs comprises four legs, and said plurality of extension sleeves comprises four sleeves.

4. The cuff protective device of claim 1, wherein said button is formed integrally with said leg.

5. The cuff protective device of claim 4, wherein said button is molded integrally with said leg.

6. The cuff protective device of claim 1, wherein said spring clip is formed integrally with said extension sleeve.

7. The cuff protective device of claim 6, wherein said spring clip is molded integrally with said extension sleeve.

8. The cuff protective device of claim 1, wherein said interior lumen opening is flanged.

9. A method of protecting pants cuffs comprising:

(a) pivotably mounting a plurality of legs on a plurality of mounting pins extending from a central hub;

(b) slideably mounting each of said plurality of legs within an interior lumen of an extendable sleeve, each of said legs having a button protruding therefrom for releasably securing said leg to corresponding positioning holes formed in said sleeve, each of said sleeves comprising a spring clip extending outwardly from the distal end of said sleeve;

(c) releasably securing one of said spring clips to the back portion of a shoe;

(d) releasably securing said pants cuffs between said clip and its corresponding sleeve.

* * * * *